US005934452A

United States Patent [19]

Sanguedolce

[11] Patent Number: 5,934,452

[45] Date of Patent: Aug. 10, 1999

[54] EXTENDER FOR A ROCKER TYPE LIGHT SWITCH

[76] Inventor: Michael Sanguedolce, 154 Clinton Ave., Mastic, N.Y. 11950

[21] Appl. No.: 09/076,641

[22] Filed: May 12, 1998

[51] Int. Cl.[6] ..... H01H 3/02

[52] U.S. Cl. ..... 200/331

[58] Field of Search ..... 74/503, 544; 174/66, 174/67, 52.1, 53; 200/330, 331, 333, 337, 338, 547; 220/3.7; 439/135, 136, 140–145, 147, 149

[56] References Cited

U.S. PATENT DOCUMENTS 4,105,884 8/1978 Damsky ..... 200/331
4,454,401 6/1984 Powis et al. ..... 200/331
4,914,265 4/1990 Mongeau ..... 200/330
5,577,602 11/1996 Conner et al. ..... 200/331

*Primary Examiner*—Michael A. Friedhofer
*Attorney, Agent, or Firm*—Michael I. Kroll

[57] ABSTRACT

An extender (12) for a rocker type light switch (14) installed within a switch box (16) in a wall (18). The rocker type light switch (14) is of the type having a rocker lever (20), a switch plate (22) and a pair of mounting screws (24). The extender (12) comprises a slide handle (26), a cam button (28) in the slide handle (26) and a structure (30) for connecting the slide handle (26) in an upright position over the switch plate (22) via the mounting screws (24). The slide handle (26) can be manually moved up and down by a small child (32), allowing the cam button (28) to operate the rocker lever (20) of the rocker type light switch (14) between an on and off position.

16 Claims, 5 Drawing Sheets

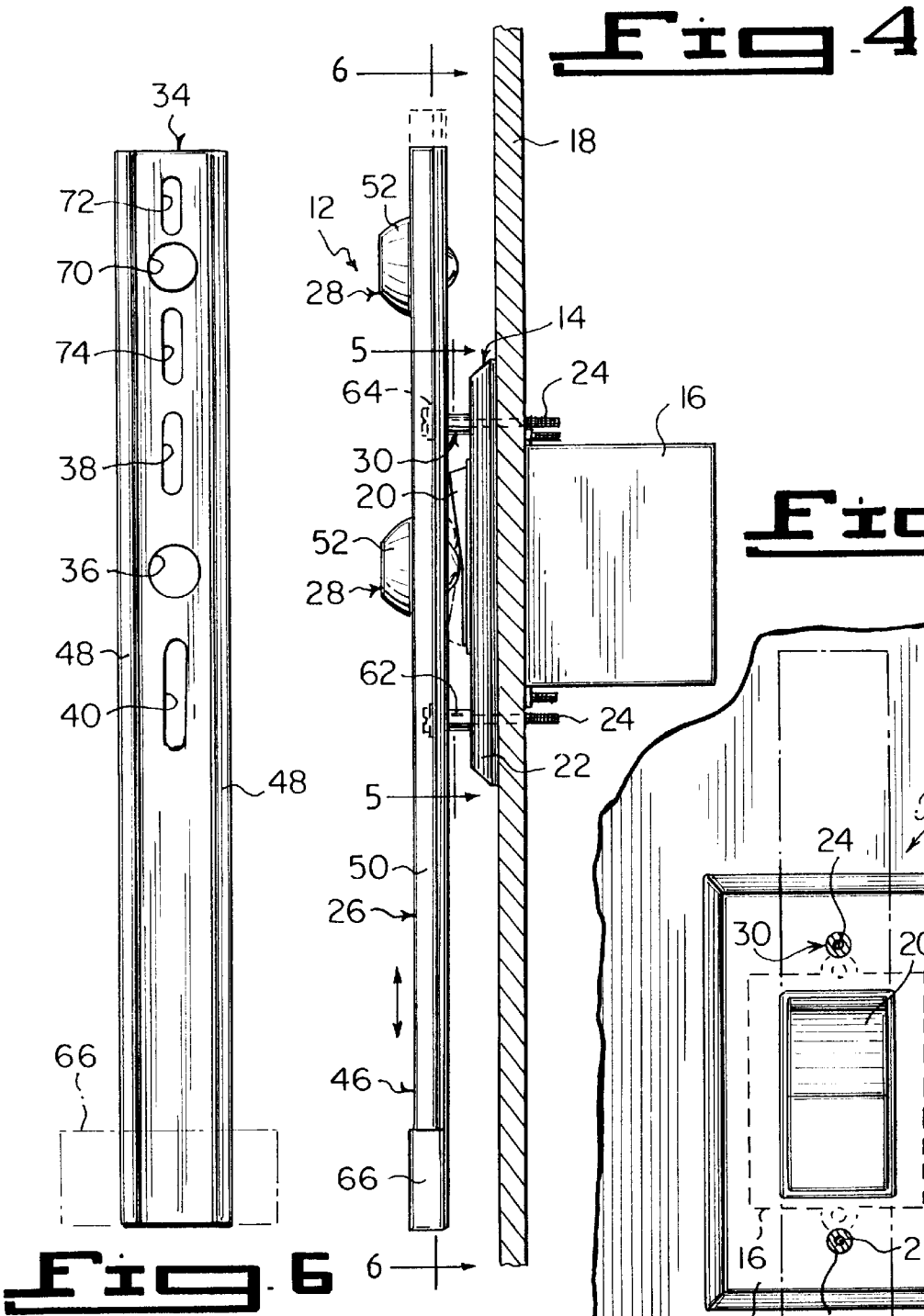
Fig. 4
Fig. 6
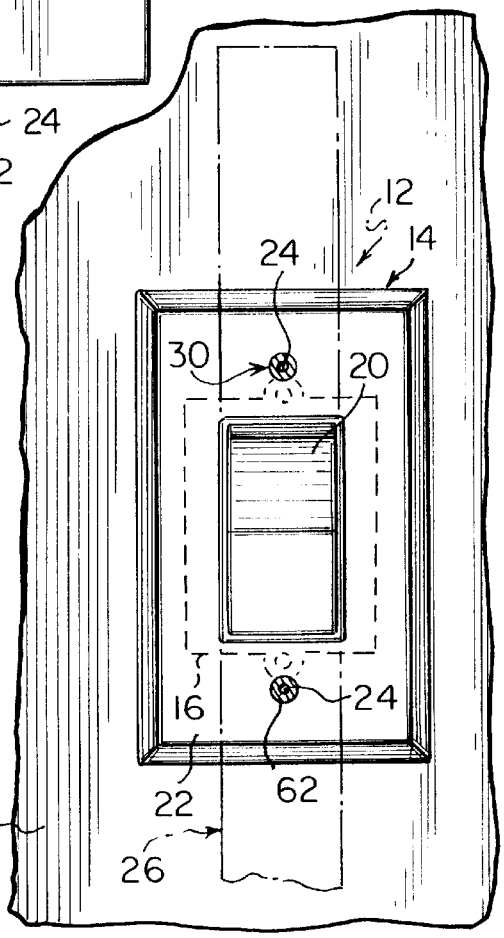
Fig. 5

Fig. 7
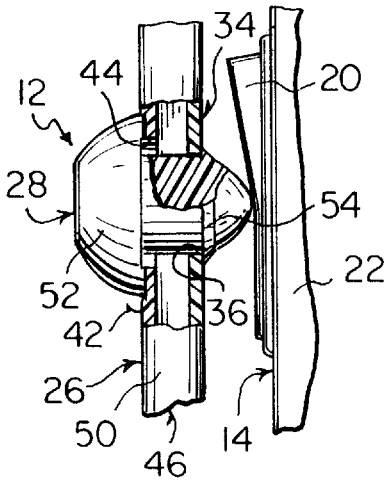
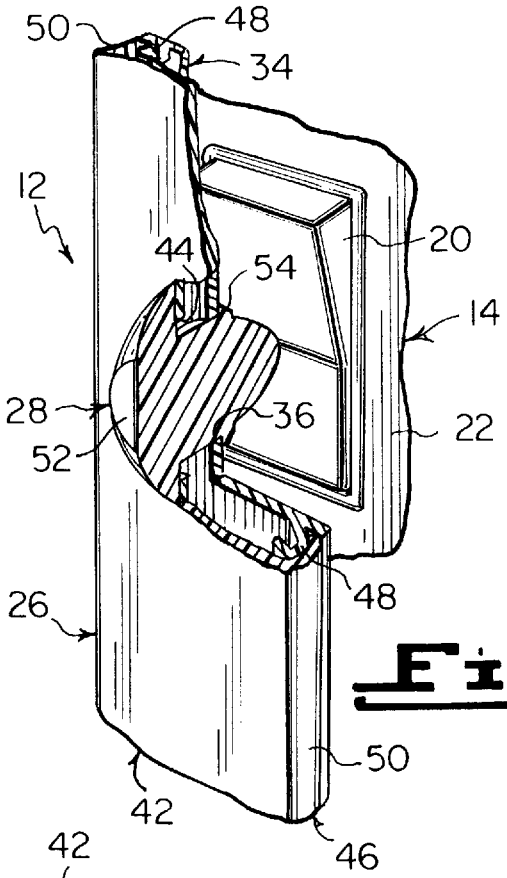
Fig. 8
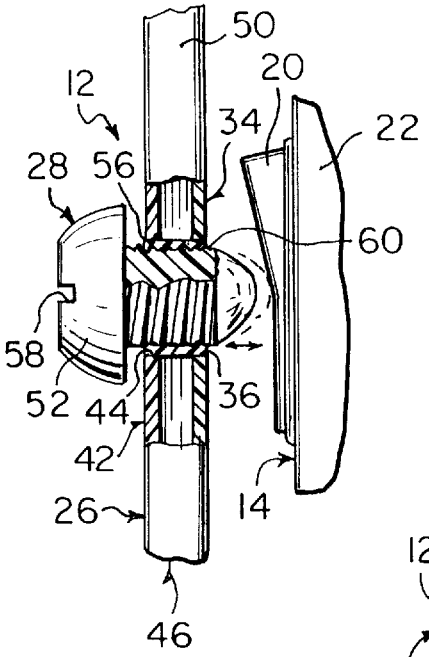
Fig. 9
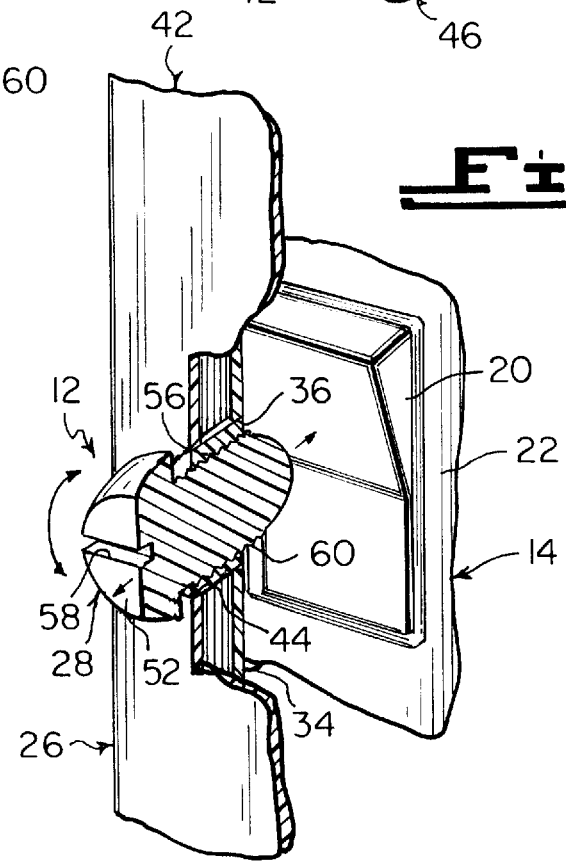
Fig. 10

EXTENDER FOR A ROCKER TYPE LIGHT SWITCH

BACKGROUND OF THE INVENTION

1. Field of the Invention

The instant invention relates generally to light switch extension levers and more specifically it relates to an extender for a rocker type light switch. The extender for a rocker type light switch consists of a slide handle with a cam button which is connected over the switch plate, so that a small child can move the slide handle up and down, allowing the cam button to operate the rocker lever of the rocker type light switch between an on and off position. The cam button can be threaded into the slide handle and have a screwdriver slot, so that it can be adjusted with respect to the rocker lever of the rocker type light switch, to compensate for variations between manufacturing standard of different switch manufacturers.

2. Description of the Prior Art

Numerous light switch extension levers have been provided in prior art. For example, U.S. patents numbered U.S. Pat. No. 4,105,884 to Damsky; U.S. Pat. No. 4,454,401 to Powis, Jr.; U.S. Pat. No. 4,914,265 to Mongeau and U.S. Pat. No. 5,577,602 to Conner et al. all are illustrative of such prior art. While these units may be suitable for the particular purpose to which they address, they would not be as suitable for the purposes of the present invention as heretofore described.

U.S. Pat. No. 4,105,884 discloses a substitute toggle switch cover plate has an elongated opening within which is reciprocatively captured. An actuating member having a recessed carrier portion at the inside is adapted to loosely enclose the control lever of an electrical toggle switch. A slide knob at the outside is for moving the carrier member together with the toggle switch lever between "on" and "off" positions.

U.S. Pat. No. 4,454,401 discloses a modified wall plate for a standard toggle switch outlet is equipped with an arm or lever adapted to slide on the plate. The arm or lever is provided with a hollowed protuberance extending outwardly from the front face of the arm and arranged to receive and enclose the actuating finger of a standard toggle switch when the modified wall plate is attached at an existing wall outlet for the switch. The arm or lever is equipped with a detachable rod extending to a substantial distance below the bottom of the wall plate to a level within reach of a small child, thus enabled to safely operate the switch.

U.S. Pat. No. 4,914,265 discloses a new cover assemblies for electrical fixtures in buildings allow conventional outlet and (toggle) light switches to be cheaply converted into a variety of different color designs and/or colors without changing the electrical infrastructure of the fixture. The cover assemblies comprise a cover plate with an appropriate number of orifices, each orifice being covered by a slider, so that the whole cover assembly shields the conventional parts of the fixtures normally visible in building interiors.

U.S. Pat. No. 5,577,602 discloses a switch extender for electrical switches having a front plate slideably coupled to a back plate which in turn is attached to a wall-mounted switch plate. The back plate includes a knock-out portion which allows use of the invention with both toggle switches and rocker switches. A pair of cylindrical bars are positioned within an opening in the front plate. A toggle switch fits within a slot between the bars, and the corners of a rocker switch fit within slots outside of the bars on the front plate. Sliding the front plate relative to the back plate actuates the switch.

SUMMARY OF THE INVENTION

A primary object of the present invention is to provide an extender for a rocker type light switch that will overcome the shortcomings of the prior art devices.

Another object is to provide an extender for a rocker type light switch that consists of a slide handle with a cam button, which is connected over the switch plate, so that a small child can move the slide handle up and down, allowing the cam button to operate the rocker lever of the rocker type light switch between an on and off position.

An additional object is to provide an extender for a rocker type light switch in which the cam button can be threaded into the slide handle and have a screwdriver slot, so that it can be adjusted with respect to the rocker lever of the rocker type light switch to compensate for variations between manufacturing standards of different switch manufacturers.

A further object is to provide an extender for a rocker type light switch that is simple and easy to use.

A still further object is to provide an extender for a rocker type light switch that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 4 is a side view taken in the direction of arrow 4 in FIG. 3.

FIG. 5 is a cross sectional view taken along line 5—5 in FIG. 4.

FIG. 6 is an elevational view taken along line 6—6 in FIG. 4, showing the rear rectangular base member of the slide handle.

FIG. 7 is a side view taken in the direction of arrow 7 in FIG. 3, with parts broken away and in section, showing a snap-in cam button.

FIG. 8 is a perspective view of an area in FIG. 3, as indicated by arrow 8, with parts broken away and in section, showing the snap-in cam button.

FIG. 9 is a side view similar to FIG. 7 taken in the direction of arrow 9 in FIG. 3, with parts broken away and in section, showing a screw-in adjustable cam button.

FIG. 10 is a perspective view of an area in FIG. 3, as indicated by arrow 10, with parts broken away and in section, showing the screw-in adjustable cam button.

Similar reference characters denote corresponding features consistently throughout the attached drawings.

DETAILED DESCRIPTION OF THE PREFERRED EMBODIMENTS

Figure 1:
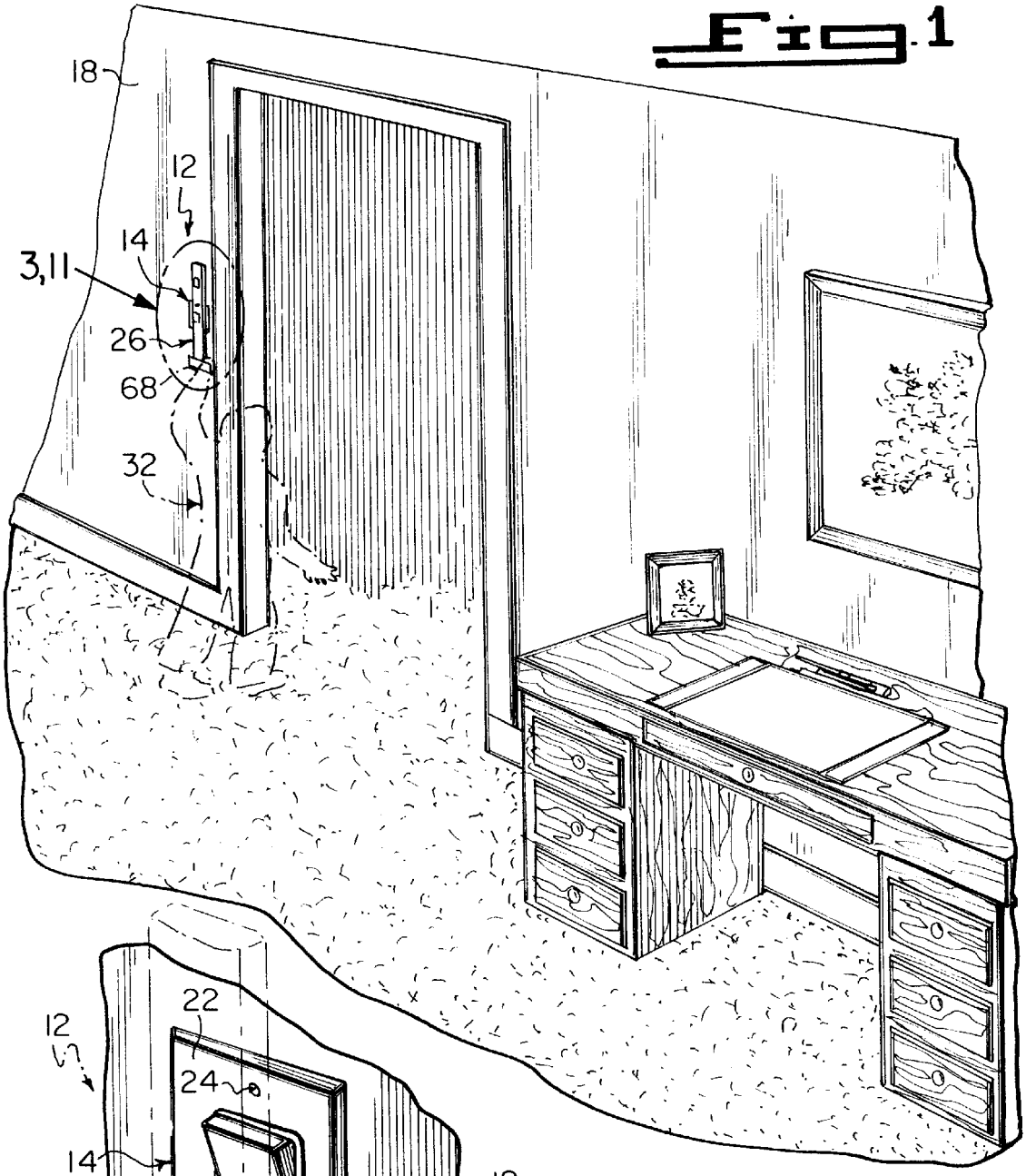
FIG. 1 is a perspective view showing the present invention in use by a small child, shown in phantom.
Figure 2:
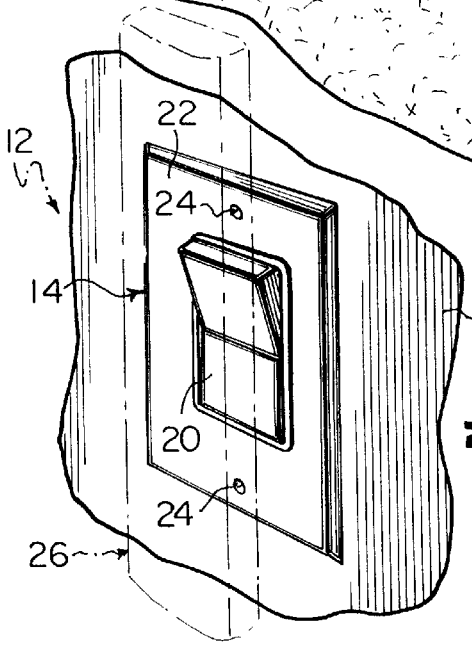
FIG. 2 is an enlarged perspective view of the rocker type light switch in the wall, with a portion of the present invention shown in phantom.
Figure 3:
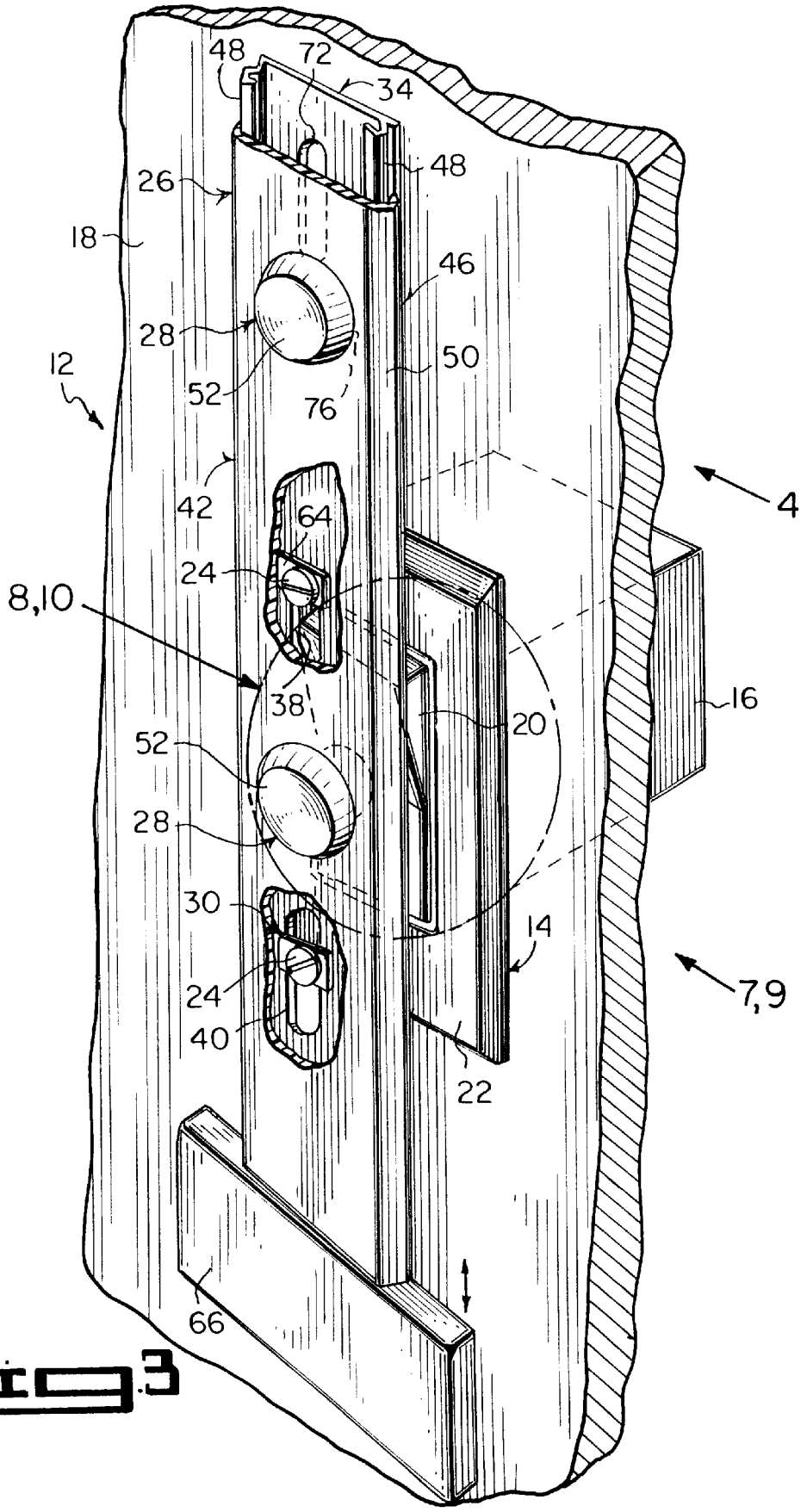
FIG. 3 is a further enlarged perspective view of the area in FIG. 1 indicated by arrow 3, with parts broken away and in section.

Turning now descriptively to the drawings, in which similar reference characters denote similar elements throughout the several views, FIGS. 1 through 11 illustrate the present invention being an extender 12 for a rocker type light switch 14.

The extender 12 is for a rocker type light switch 14 installed within a switch box 16 in a wall 18. The rocker type light switch 14 is of the type having a rocker lever 20, a switch plate 22 and a pair of mounting screws 24. The extender 12 comprises a slide handle 26, a cam button 28 in the slide handle 26 and a structure 30 for connecting the slide handle 26 in an upright position over the switch plate 22 via the mounting screws 24. The slide handle 26 can be manually moved up and down by a small child 32, allowing the cam button 28 to operate the rocker lever 20 of the rocker type light switch 14 between an on and off position.

The slide handle 26 includes a rear rectangular base member 34 having an orifice 36 and a pair of narrow openings 38, 40 in which the first narrow opening 38 is above the orifice 36, while the second narrow opening 40 is located below the orifice 36. A front rectangular cover member 42 has an orifice 44, which normally is in alignment with the orifice 36 in the rear rectangular base member 34. The cam button 28 can extend through and be maintained within the orifice 44 in the front rectangular cover member 34 and the orifice 36 in the rear rectangular base member 34. A facility 46 is for securing the front rectangular cover member 42 to the rear rectangular base member 34.

The securing facility 46 consists of the rear rectangular base member 34 having a pair of longitudinal groove segments 48, in which each longitudinal groove segment 48 is located along one long side thereof. The front rectangular cover member 42 has a pair of longitudinal tongue segments 50, in which each longitudinal tongue segment 50 is located along one long side thereof. The longitudinal tongue segments 50 on the front rectangular cover member 42 can slip onto and engage with the longitudinal groove segments 48 on the rear rectangular base member 34.

The cam button 28, as best seen in FIGS. 7 and 8, includes an enlarged forward head 52 and an annular flange 54 near a rearward end. The cam button 28 can pass through the orifice 44 in the front rectangular cover member 42 and snap into the orifice 36 in the rear rectangular base member 34, with the rearward end extending past the rear rectangular base member 34, to make contact with the rocker lever 20 of the rocker type light switch 14.

FIGS. 9 and 10 show an internally threaded collar 56, which fits snugly horizontally past the orifice 44 in the front rectangular cover member 42 and the orifice 36 in the rear rectangular base member 34. The cam button 28 has the enlarged forward head 52 with a screwdriver slot 58 and an externally threaded shaft 60. The externally threaded shaft 60 can be adjusted within the internally threaded collar 56, when a screwdriver blade engages with the screwdriver slot 58 and places a rearward end of the cam button 28 against the rocker lever 20 of the rocker type light switch 14, to compensate for variations between manufacturing standards of different switch manufacturers.

The connecting structure 30 includes a pair of spacers 62 to fit over the mounting screws 24 between a back surface of the rear rectangular base member 34 and a front surface of the switch plate 22. A pair of washers 64 fit over the mounting screws 24 between a back surface of each head of the mounting screws 24 and a front surface of the rear rectangular base member 34 at each narrow opening 38 and 40. Each washer 64 can be integrally formed to the head of each mounting screw 24, making each mounting screw 24 a slot head screw.

A T-grip holder 66 is affixed transversely to a lower end of the front rectangular cover member 42 of the slide handle 26. A hand 68 of the small child 32 can grasp the T-grip holder 66, to better manually move the slide handle 26 up and down.

The slide handle 26 further consists of the rear rectangular base member 34 having a second orifice 70 and a second pair of narrow openings 72, 74 above the first orifice 36 and the first pair of narrow openings 38, 40. The front rectangular cover member 42 has a second orifice 76, which normally is in alignment with the second orifice 70 in the rear rectangular base member 34. The cam button 28 can extend through and be maintained within the second orifice 76 in the front rectangular cover member 42 and the second orifice 70 in the rear rectangular base member 34. The connecting structure 30 can be placed at the second pair of narrow openings 72, 74 in the rear rectangular base member 34, to change height adjustment of the slide handle 26 with respect to the size of the small child 32.

Figure 11:
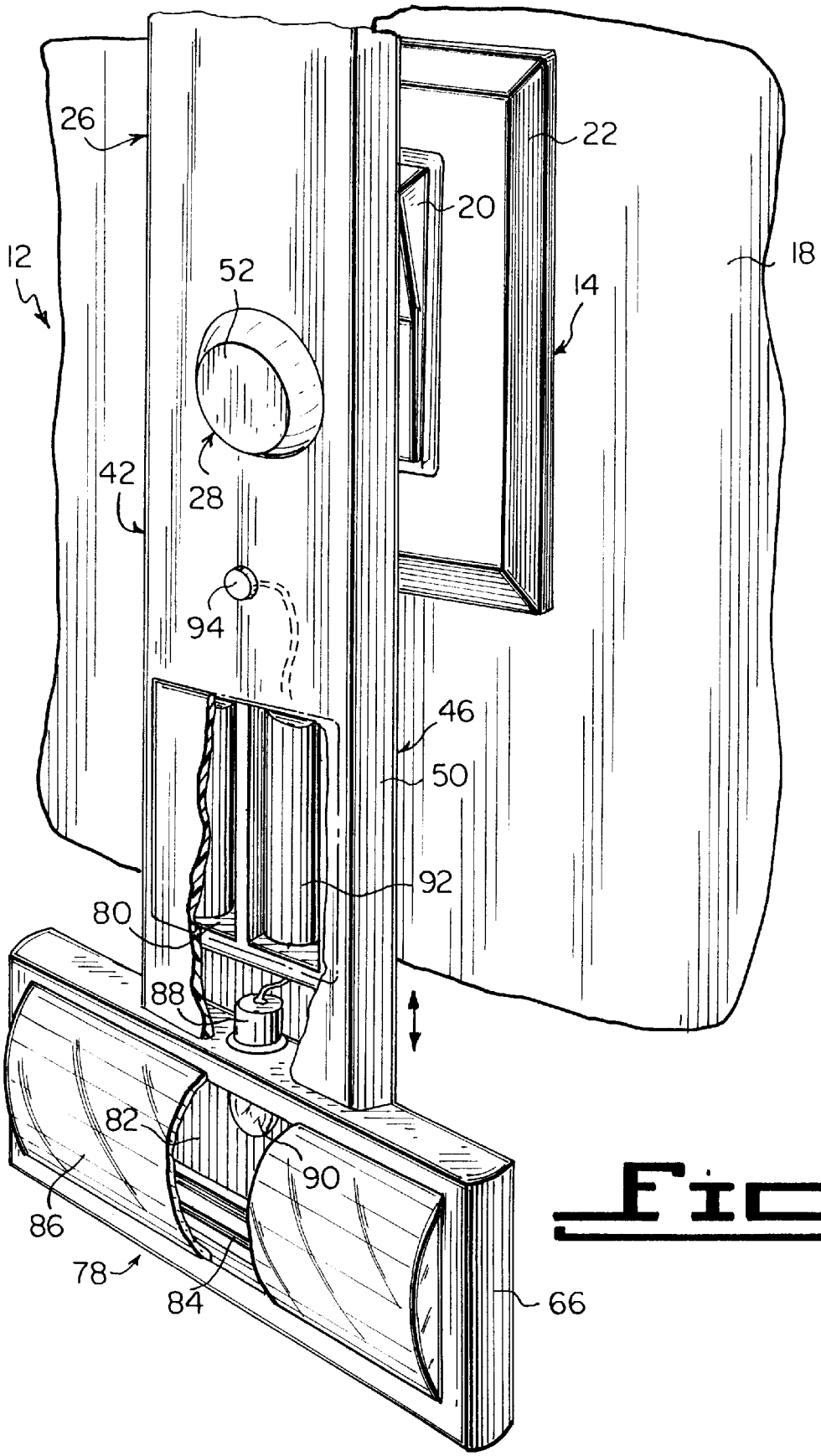
FIG. 11 is an enlarged perspective view similar to FIG. 3, as indicated by arrow 11, with parts broken away and in section, showing an illumination assembly therein.

FIG. 11 shows an illumination assembly 78 in a lower portion of the slide handle 26, so as to provide light to the T-grip holder 66 when the extender 12 is over the rocker type light switch 14 in a dark room. The illumination assembly 78 comprises the slide handle 26 having a compartment 80 in its lower portion. The T-grip holder 66 has a chamber 82 with a plurality of lower slots 84 therein. A lens 86 is mounted in a front wall of the T-grip holder 66. A light socket 88 is mounted vertically between the compartment 80 in the slide handle 26 and the chamber 82 in the T-grip holder 66. A light bulb 90 in the light socket 88 extends downwardly into the chamber 82 of the T-grip holder 78. At least one battery 92 in the compartment 80 in the slide handle 26 is electrically connected to the light socket 88. A photoelectric sensor 94, being a phototransistor or photoresistor relay in the lower portion of the slide handle 26, is electrically connected to the at least one battery 92. The photoelectric sensor 94 being responsive to movement and/or darkness, will cause the light bulb 90 to illuminate and radiate light out through the lens 86 and the slots 84 in the T-grip holder 66.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An extender for a rocker type light switch installed within a switch box in a wall, the rocker type light switch includes a rocker lever, a switch plate and a pair of mounting screws, each of said pair of mounting screws having a head said extender comprising:

a) a slide handle, wherein said slide handle includes a rear rectangular base member having a first orifice and first and second narrow openings, in which said first narrow opening is above said orifice, while said second narrow opening is located below said orifice, a front rectangular cover member having a first orifice and means for securing said front rectangular cover member to said rear rectangular base member;

b) a cam button in said slide handle, wherein said first orifice in said front rectangular cover member being in alignment with said orifice in said rear rectangular base member, so that said cam button can extend through and be maintained within said orifice in said front rectangular cover member and said first orifice in said rear rectangular base member; and c) means for connecting said slide handle in an upright position over the switch plate via the mounting screws, so that said slide handle can be manually moved up and down by a small child, allowing said cam button to move the rocker lever of the rocker type light switch between an on and off position.

2. An extender as recited in claim 1, wherein said cam button includes an enlarged forward head and an annular flange near a rearward end, so that said cam button can pass through said first orifice in said front rectangular cover member and snap into said first orifice in said rear rectangular base member, with said rearward end extending past said rear rectangular base member, to make contact with the rocker lever of the rocker type light switch.

3. An extender as recited in claim 1, further including:

a) an internally threaded collar which fits snugly horizontally past said first orifice in said front rectangular cover member and said first orifice in said rear rectangular base member; and b) said cam button having an enlarged forward head with a screwdriver slot and an externally threaded shaft, so that said externally threaded shaft can be adjusted within said internally threaded collar, when a screwdriver blade engages with said screwdriver slot and places a rearward end of said cam button against the rocker lever of the rocker type light switch, to compensate for variations between manufacturing standards of different switch manufacturers.

4. An extender as recited in claim 1, wherein said connecting means includes:

a) a pair of spacers to fit over the mounting screws between a back surface of said rear rectangular base member and a front surface of the switch plate; and b) a pair of washers to fit over the mounting screws between a back surface of each of the heads of the mounting screws and a front surface of said rear rectangular base member at each of said first and second narrow openings.

5. An extender as recited in claim 1, further including a T-grip holder affixed transversely to a lower end of said front rectangular cover member of said slide handle, so that a hand of the small child can grasp said T-grip holder to better manually move said slide handle up and down.

6. An extender as recited in claim 5, further including an illumination assembly in a lower portion of said slide handle, so as to provide light to said T-grip holder when said extender is over the rocker type light switch in a dark room.

7. An extender as recited in claim 6, wherein said illumination assembly includes:

a) said slide handle having a compartment in a lower portion; thereof b) said T-grip holder having a chamber with a plurality of lower slots therein;

c) a lens mounted in a front wall of said T-grip holder;

d) a light socket mounted vertically between said compartment in said slide handle and said chamber in said T-grip holder;

e) a light bulb in said light socket which extends downwardly into said chamber of said T-grip holder;

f) at least one battery in said compartment in said slide handle electrically connected to said light socket; and g) a photoelectric sensor in the lower portion of said slide handle, electrically connected to said at least one battery, so that said photoelectric sensor being responsive to at least one of movement and darkness will cause said light bulb to illuminate and radiate light out through said lens and the slots in said T-grip holder.

8. An extender as recited in claim 1, wherein said slide handle further includes:

a) said rear rectangular base member having a second orifice and a second pair of narrow openings above said first orifice and said first and second narrow openings in said rear rectangular base member; and b) said front rectangular cover member having a second orifice which normally is in alignment with said second orifice in said rear rectangular base member, so that said cam button can extend through and be maintained within said second orifice in said front rectangular cover member and said second orifice in said rear rectangular base member, while said connecting means can be placed at said second pair of narrow openings in said rear rectangular base member to change height adjustment of said slide handle with respect to the size of the small child.

9. An extender as recited in claim 1, wherein said securing means includes:

a) said rear rectangular base member having a pair of longitudinal groove segments, in which each of said pair said longitudinal groove segments is located along one long side thereof; and b) said front rectangular cover member having a pair of longitudinal tongue segments, in which each of said pair said longitudinal tongue segments is located along one long side thereof, so that said longitudinal tongue segments on said front rectangular cover member can slip onto and engage with said longitudinal groove segments on said rear rectangular base member.

10. An extender as recited in claim 9, wherein said cam button includes an enlarged forward head and an annular flange near a rearward end, so that said cam button can pass through said first orifice in said front rectangular cover member and snap into said first orifice in said rear rectangular base member, with said rearward end extending past said rear rectangular base member, to make contact with the rocker lever of the rocker type light switch.

11. An extender as recited in claim 9, further including:

a) an internally threaded collar which fits snugly horizontally past said first orifice in said front rectangular cover member and said first orifice in said rear rectangular base member; and b) said cam button having an enlarged forward head with a screwdriver slot and an externally threaded shaft, so that said externally threaded shaft can be adjusted within said internally threaded collar, when a screwdriver blade engages with said screwdriver slot and places a rearward end of said cam button against the rocker lever of the rocker type light switch, to compensate for variations between manufacturing standards of different switch manufacturers.

12. An extender as recited in claim 9, wherein said connecting means includes:

a) a pair of spacers to fit over the mounting screws between a back surface of said rear rectangular base member and a front surface of the switch plate; and b) a pair of washers to fit over the mounting screws between a back surface of each of said heads of the mounting screws and a front surface of said rear rectangular base member at each of said first and second narrow openings.

13. An extender as recited in claim 12, further including a T-grip holder affixed transversely to a lower end of said front rectangular cover member of said slide handle, so that a hand of the small child can grasp said T-grip holder to better manually move said slide handle up and down.

14. An extender as recited in claim 13, wherein said slide handle further includes:

a) said rear rectangular base member having a second orifice and a second pair of narrow openings above said first orifice and said first and second narrow openings in said rear rectangular base member; and b) said front rectangular cover member having a second orifice which normally is in alignment with said second orifice in said rear rectangular base member, so that said cam button can extend through and be maintained within said second orifice in said front rectangular cover member and said second orifice in said rear rectangular base member, while said connecting means can be placed at said second pair of narrow openings in said rear rectangular base member to change height adjustment of said slide handle with respect to the size of the small child.

15. An extender as recited in claim 14, further including an illumination assembly in a lower portion of said slide handle, so as to provide light to said T-grip holder when said extender is over the rocker type light switch in a dark room.

16. An extender as recited in claim 15, wherein said illumination assembly includes:

a) said slide handle having a compartment in a lower portion; thereof b) said T-grip holder having a chamber with a plurality of lower slots therein;

c) a lens mounted in a front wall of said T-grip holder;

d) a light socket mounted vertically between said compartment in said slide handle and said chamber in said T-grip holder;

e) a light bulb in said light socket which extends downwardly into said chamber of said T-grip holder;

f) at least one battery in said compartment in said slide handle electrically connected to said light socket; and g) a photoelectric sensor in the lower portion of said slide handle, electrically connected to said at least one battery, so that said photoelectric sensor being responsive to at least one of movement and darkness will cause said light bulb to illuminate and radiate light out through said lens and the slots in said T-grip holder.

* * * * *